US006513246B2

(12) United States Patent
Ping

(10) Patent No.: US 6,513,246 B2
(45) Date of Patent: Feb. 4, 2003

(54) UTILITY KNIFE

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 09/892,868

(22) Filed: Jun. 28, 2001

(65) Prior Publication Data

US 2002/0056198 A1 May 16, 2002

Related U.S. Application Data

(63) Continuation-in-part of application No. 09/712,484, filed on Nov. 14, 2000, now Pat. No. 6,446,340.

(30) Foreign Application Priority Data

Apr. 24, 2001 (CN) ..... 01239012 U

(51) Int. Cl.[7] ..... B26B 1/08; B26B 5/00
(52) U.S. Cl. ..... 30/125; 30/162; 30/335
(58) Field of Search ..... 30/2, 125, 162, 30/335

(56) References Cited

U.S. PATENT DOCUMENTS

| | | | | |
|---|---|---|---|---|
| 2,172,072 | A | 9/1939 | Rothschild | |
| 2,467,481 | A | 4/1949 | Huff | |
| 2,948,961 | A | 8/1960 | Ortner | |
| 2,967,354 | A | 1/1961 | Ahlborn | |
| 3,316,635 | A | 5/1967 | Merrow | |
| 3,509,627 | A | 5/1970 | Gilbert | |
| 3,577,637 | A | 5/1971 | Braginetz | 30/162 |
| 3,593,417 | A | 7/1971 | West | 30/125 |
| 3,660,896 | A | 5/1972 | Umholtz | 30/162 |
| 3,708,881 | A | 1/1973 | Bennett | 30/335 |
| 3,845,554 | A | 11/1974 | Joanis | 30/125 |
| 3,872,591 | A | 3/1975 | Ouenot | 30/162 |
| 3,879,847 | A | 4/1975 | Roll | 30/162 |
| 3,888,002 | A | 6/1975 | Graham | 30/162 |
| 4,005,525 | A | 2/1977 | Gringer | 30/125 |
| 4,196,515 | A | 4/1980 | Sugiyama | 30/162 |
| 4,227,306 | A | 10/1980 | Meshulam | 30/335 |
| 4,242,795 | A | 1/1981 | Rollband | 30/162 |
| 4,277,888 | A | 7/1981 | Szabo | 30/162 |
| 4,320,576 | A | 3/1982 | Beermann | 30/162 |
| 4,517,741 | A | 5/1985 | Castelluzzo | 30/162 |
| 4,586,256 | A | 5/1986 | Weimann | 30/162 |
| 4,621,425 | A | 11/1986 | Stoutenberg | 30/162 |
| 4,663,845 | A | 5/1987 | Weinmann | 30/162 |
| 4,761,882 | A | 8/1988 | Silverstein | 30/162 |
| 4,813,132 | A | 3/1989 | Castelluzzo | 30/162 |
| 4,939,839 | A | 7/1990 | Gorst | 30/125 |
| 4,941,260 | A | 7/1990 | Castelluzzo | 30/162 |
| 4,974,320 | A | 12/1990 | Pelletier | 30/335 |
| 5,099,578 | A | 3/1992 | Jan | 30/162 |
| 5,301,428 | A | 4/1994 | Wilcox | 30/162 |
| 5,315,760 | A | 5/1994 | Emerson | 30/123 |
| 5,406,707 | A | 4/1995 | Owens | 30/162 |
| 5,459,647 | A | 10/1995 | Betts | 362/119 |
| 5,495,670 | A | 3/1996 | Ouinn | 30/162 |
| 5,509,205 | A | 4/1996 | Ragland, III | 30/162 |
| 5,613,300 | A | 3/1997 | Schmidt | 30/125 |
| 5,644,843 | A | 7/1997 | Young | 30/162 |
| 5,862,596 | A | 1/1999 | Chung | 30/335 |
| 5,870,828 | A | 2/1999 | Polites | 30/162 |
| 5,909,930 | A | 6/1999 | Ragland et al. | 30/125 |
| 5,950,311 | A | 9/1999 | Huang | 30/162 |
| 5,966,817 | A | 10/1999 | Lee | 30/162 |
| 6,000,136 | A | 12/1999 | Owens | 30/162 |
| 6,041,505 | A | 3/2000 | Chen | 30/162 |
| 6,044,560 | A | 4/2000 | Chao | 30/162 |
| 6,058,607 | A | 5/2000 | Gringer | 30/162 |

*Primary Examiner*—Hwei-Siu Payer
(74) *Attorney, Agent, or Firm*—Joseph J. Previto

(57) ABSTRACT

A utility knife having a casing with lock notches therein. A blade moving mechanism slidably mounted with its casing. The blade moving mechanism having blade holding finger adapted to receive a blade. The blade moving mechanism has a strap with a lock mechanism extending therefrom. The lock mechanism is adapted to cooperate with the lock notches in the casing to hold the blade moving mechanism in a predetermined position with the casing.

9 Claims, 7 Drawing Sheets

UTILITY KNIFE

RELATED APPLICATION

This application is a continuation-in-part of pending U.S. patent application Ser. No. 09/712,484, filed Nov. 14, 2000 now U.S. Pat. No. A6,446,340.

BACKGROUND

The present invention relates to utility knives and more particularly to utility knives in which a new blade can be automatically replaced in the knife.

Utility knives have been in use for many years. They usually comprise a blade movable within a casing. The blade is pushed forward in order to expose the cutting edge of the blade and when desired the blade may be withdrawn within the casing so that it does not pose a hazard. Some utility knives provide for the blade to be removed and automatically replaced after the cutting edge becomes dull or for some other reason. Many of these utility knives comprise complicated mechanisms for exposing and retracting the blade and for removing and replacing the blade as well as for locking the blade in extended or retracted positions. Many of such utility knives are expensive to manufacture, are complex to use and are difficult to assemble.

OBJECTS

The present invention overcomes these defects and has for one of its objects the provision of an improved utility knife which is simple to use.

Another object of the present invention is the provision of an improved utility knife in which the blades can be easily placed in an extended or a retracted position.

Another object of the present invention is the provision of an improved utility knife in which blades can be easily removed and replaced automatically.

Another object of the present invention is the provision of an improved utility knife in which the blade can be easily locked in an extended or retracted position.

Another object of the present invention is the provision of an improved utility knife which is simple to use.

Another object of the present invention is the provision of an improved utility knife which is inexpensive to manufacture.

Another object of the present invention is the provision of an improved utility knife which may be easily assembled.

Other and further objects will be obvious upon the understanding of the illustrative embodiment about to be described, or which will be indicated in the appended claims, and various advantages not referred to herein, will occur to one skilled in the art upon employment of the invention in practice.

DRAWINGS

A preferred embodiment of the invention has been chosen for the purposes of illustration and description and is shown in the accompanying drawings forming a part of the specification wherein.

DESCRIPTION

Figure 4:
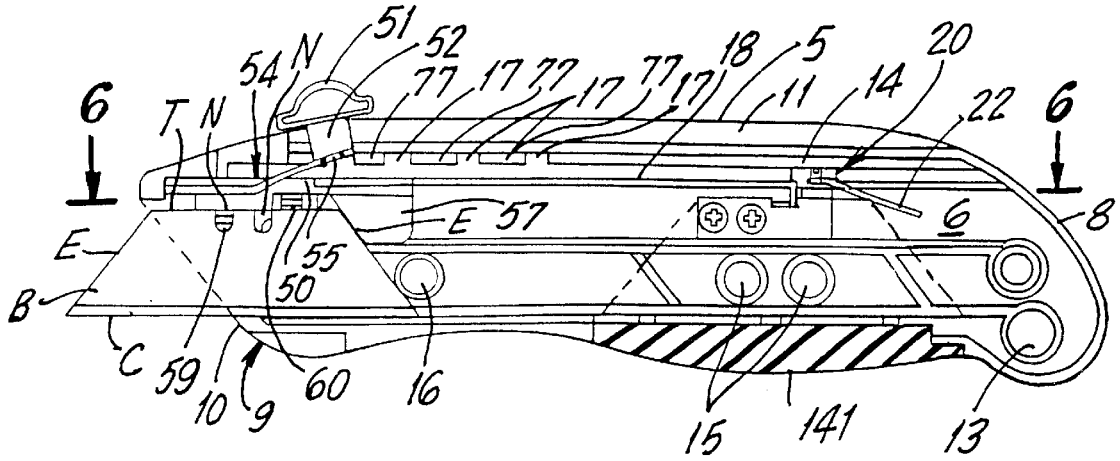
FIG. 4 is a side elevational view of the interior of the utility knife showing the position of some of the parts when the blade is in extended position.
Figure 5:
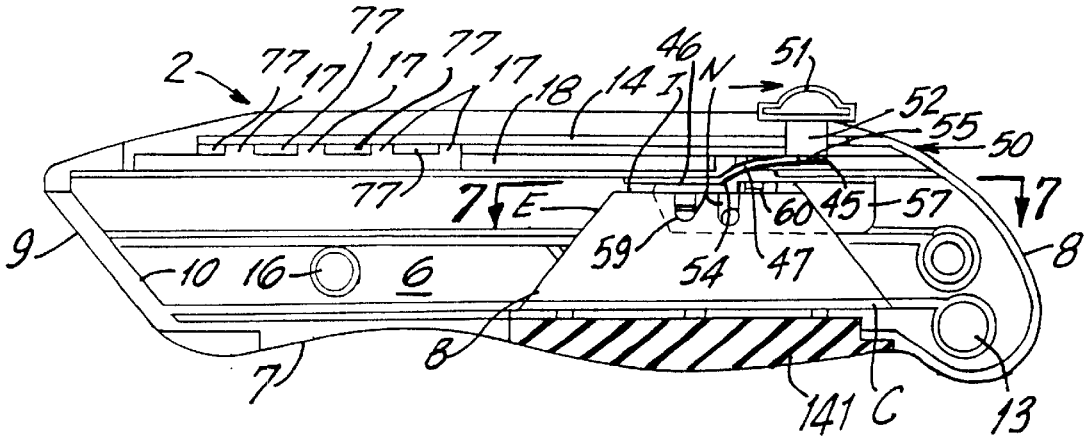
FIG. 5 is an elevational view similar to FIG. 4 showing the position of some of the parts when a new blade is to be added.

Referring to the drawings, the blade B preferably used with the present invention is best shown in FIG. 4 and is trapezoidal in shape having a lower cutting edge C, inwardly inclined end edges E and a shorter top edge I having a pair of notches N. It will be understood that other blades may also be used with the present invention.

Figure 1:
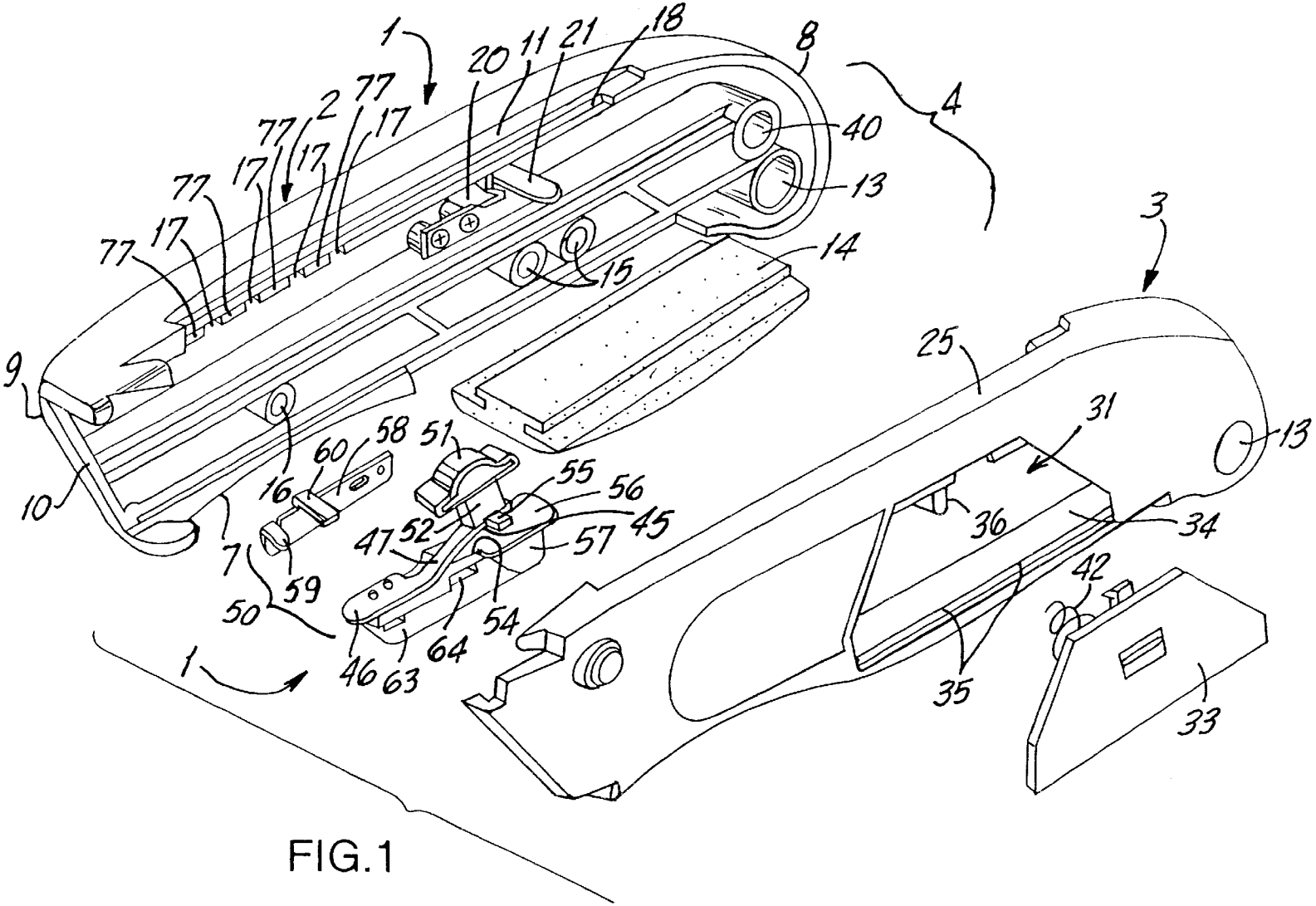
FIG. 1 is an exploded perspective view of a utility knife made in accordance with the present invention.
Figure 2:
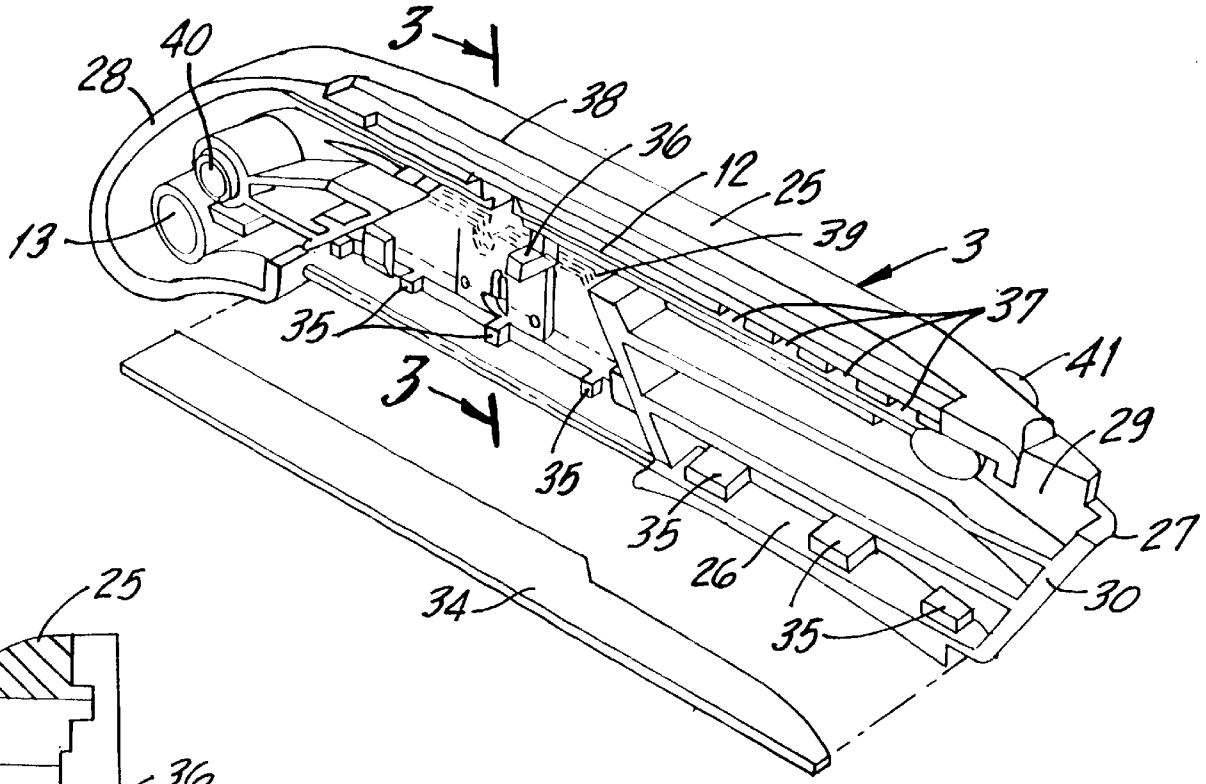
FIG. 2 is a perspective view of a casing half of the utility knife of the present invention.
Figure 3:
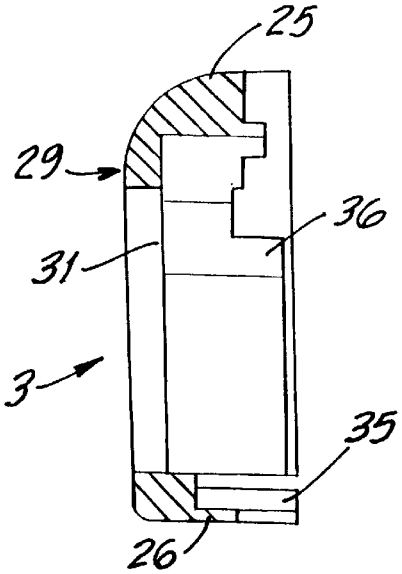
FIG. 3 is a sectional view taken along line 3—3 of FIG. 2.

Referring to FIGS. 1, 2 and 3, the utility knife 1 of the present invention comprises a first casing half 2 and a second casing half 3 which are assembled together to form the complete casing 4. A connecting strap 141 at the bottom may be provided to bridge the casing halves 2–3.

Figure 6:
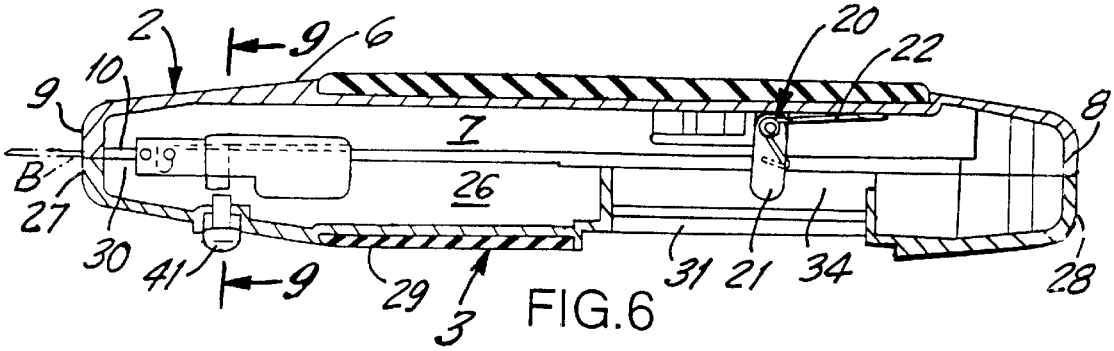
FIG. 6 is a sectional view taken along line 6—6 of FIG. 4.
Figure 8:
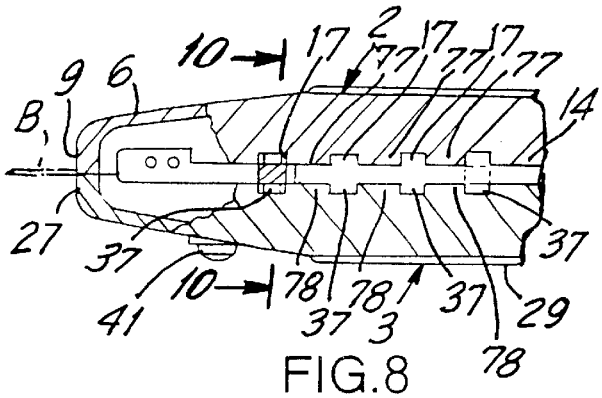
FIG. 8 is a sectional view of the front portion of the knife showing the position of some parts where the blade is extended.
Figure 7:
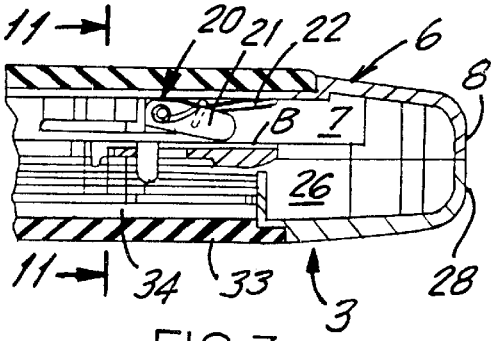
FIG. 7 is a sectional view taken along line 7—7 of FIG. 5.
Figure 9:
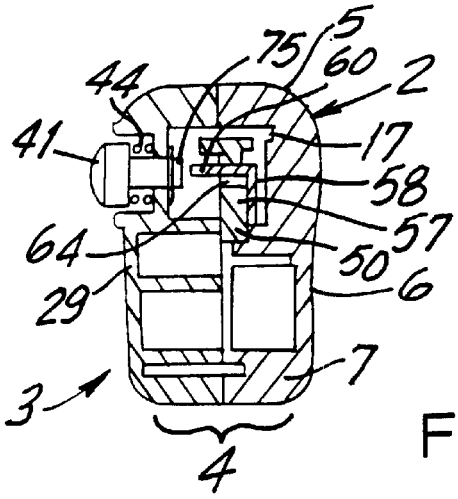
FIG. 9 is a sectional view taken along line 9—9 of FIG. 6.
Figure 10:
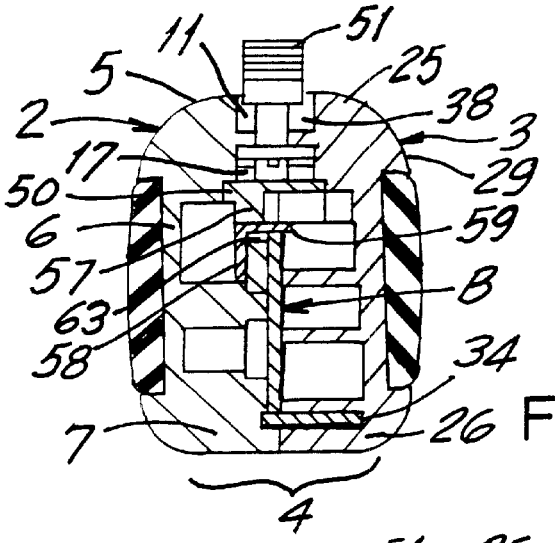
FIG. 10 is a section taken along lines 10—10 of FIG. 8.
Figure 11:
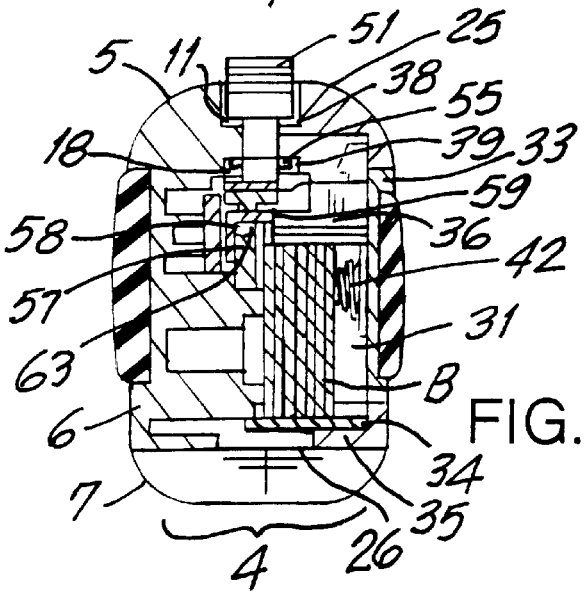
FIG. 11 is a sectional view taken along lines 11—11 in FIG. 7.
Figure 16:
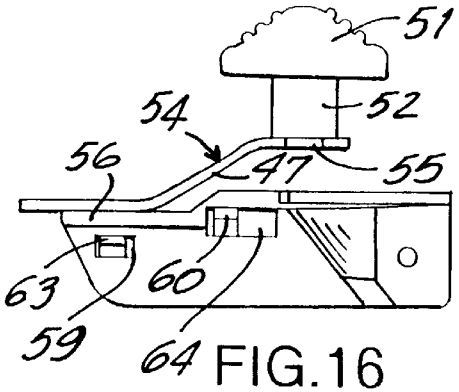
FIG. 16 is a plan view of the other side thereof.
Figure 14:
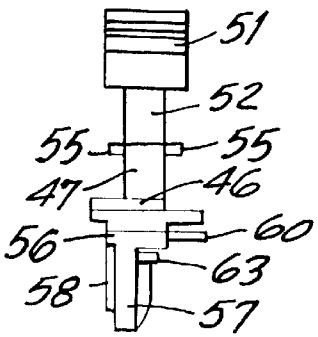
FIG. 14 is a font plan view thereof
Figure 15:
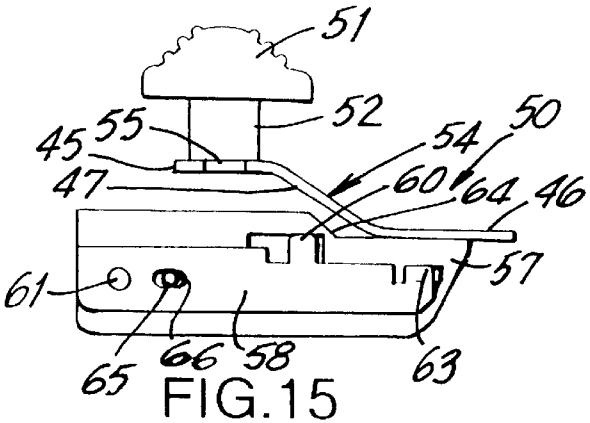
FIG. 15 is a plan view of one side thereof
Figure 12:
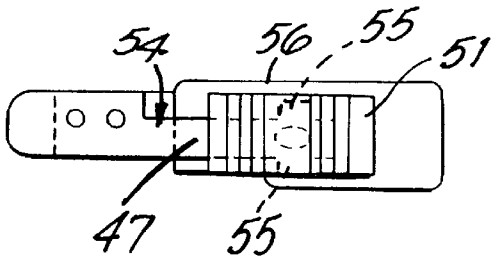
FIG. 12 is a top plan view of a blade moving slide used in the present invention.
Figure 13:
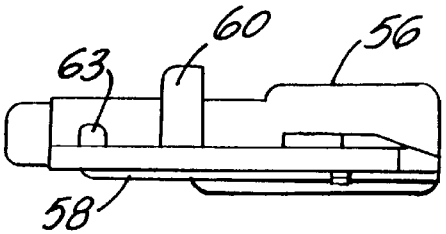
FIG. 13 is a bottom plan view thereof

The first casing half 2 has a side wall 6, a top wall 5, a bottom wall 7, a rear wall 8, and a front wall 9. The front wall 9 is angled with a partial mouth slot 10. The top wall 5 has an elongated partial slide slot 11 therein. The rear wall 8 has an opening 13 at its lower end. A plurality of magnets 15 and 16 may also be provided in side wall 6 to hold the blades B in place. The side wall 6 has a blade leveling assembly 20 on which a pivoted blade leveling arm 21 is mounted. The blade leveling arm 21 is spring pressed by spring 22 to a position at right angles to the blade leveling assembly 20 (FIG. 6) but is pivotable to a position in lengthwise alignment with and over the blade leveling assembly 20 (FIG. 7). The side wall 6 below the top wall 5 is provided with a plurality of lock notches 17 formed by spaced teeth 77 and an elongated undercut slide groove 18 rearwardly of the lock notches 17 is formed beneath a ledge 14 which is on the same level as and coextensive with the lock notches 17.

The second casing half 3 comprises a top wall 25, bottom wall 26, front wall 27, rear wall 28 and side wall 29. The front wall 27 is angled and has a partial mouth slot 30 adapted to match the partial mouth slot 10 in the first casing half 2 in order to form a mouth 10–30. The side wall 29 has a trapezoidally shaped opening 31 to receive a plurality of blades B which is adapted to be closed by a trapezoidally shaped cover 33. The side wall 29 also has a blade supporting platform 34 mounted on a plurality of spaced platform supports 35 and an inwardly extending blade notch guide finger 36 under which blades B are stacked. The blade notch guide finger 36 is inserted in the notch N of the blades and blades B will slide inwardly along guide finger 36 away from the side wall 29 (FIGS. 2 and 3). The upper part of the interior of the side wall 29 has a plurality of lock notches 37 adopted to cooperate with corresponding lock notches 17 in the first casing half 2. Lock notches 37 are formed by teeth 78 adapted to cooperate with teeth 77 in the first casing half 2. An undercut elongated slide groove 39 is also provided rearwardly of the notches 37 beneath a ledge 12 which is on the same level as and coextensive with the lock notches 37 and which adapted to cooperate with matching slide groove 18 and ledge 14 in the first casing half 2 to form slide groove 18-39 and ledge 14-12. The top wall 25 has an elongated partial slide slot 38 to match the partial slide slot 11 in the first casing half 2 to form a slide slot 11-38. The rear wall 28 has an opening 13 at its lower end and screw holes 40 may also be provided at various points on both casing halves 1 and 2 to receive screws to hold them together. A blade ejection button 41 is provided at the front end of the side wall 29 to permit a blade B to be removed, as will be further described in greater detail hereinbelow.

Blades B are stored in stacked relationship in the second casing half 3 through opening 31 and are supported by the support platform 34. They are also held in place by the magnets 15 against which they abut. When a blade B nearest the magnet 15 is removed, the other blades will be attracted toward the magnet 15 and move inwardly. The cover 33 of the opening 32 also has a spring 42 which will push the blades B inwardly against the magnets 15. The blades B are also held in place in stored and stacked position beneath pivoted blade-leveling arm 21 which is in its extended position over the blades so that the blades B are held in place between the blade-leveling arm 21, the support platform 34, the magnet 16 and the spring 42. The blades B are held against lateral movement by the inwardly directed guide finger 36 which is inserted in one of the notches N at the top edge T of the blades B and along which the blades B slide when moving inwardly. The guide finger 36 terminates at the inner edge of the second casing half 3.

A blade moving slide 50 (FIGS. 9-13) comprises a top finger button 51 and a downwardly extending main body 52 adopted to extend through and slide along the top of slide slot 11-38 in the top wall 5-25 of the casing 4. A resilient control strap 54 extends from the body 52 and has an upper rear step 45, a lower front step 46 spaced in front of and below rear step 45 and an inclined resilient ramp 47 connecting the two together. The rear and front steps 45-46 are preferably flat and parallel to each other with step 45 connected to body 52. A stop tooth 55 extends outwardly from opposite sides of the said upper rear step 45 toward the lock notches 17-37. The lock fingers 55 will normally slide in the slide grooves 18-39 below ledges 12-14 in the two casing halves 2-3, however, they are adapted to be inserted into lock notches 17-37 to hold the slide 50 in a predetermined position. Extending downwardly from and connected to the lower front step 46 is an elongated platform 56 at right angles to body 52 with a downwardly extending support bar 57 at right angles to the platform 56. A resilient blade carrier 58 is attached to the support bar 57 by screws 61 and has a lower blade pick-up finger 59 extending through a lower opening 63 in the support bar 57 and an upper blade release finger 60 extending through an upper opening 64 in the support bar 57. The blade carrier 58 is resilient so that fingers 59 and 60 may move in and out of the openings 63 and 64 in the support bar 57.

Figure 17:
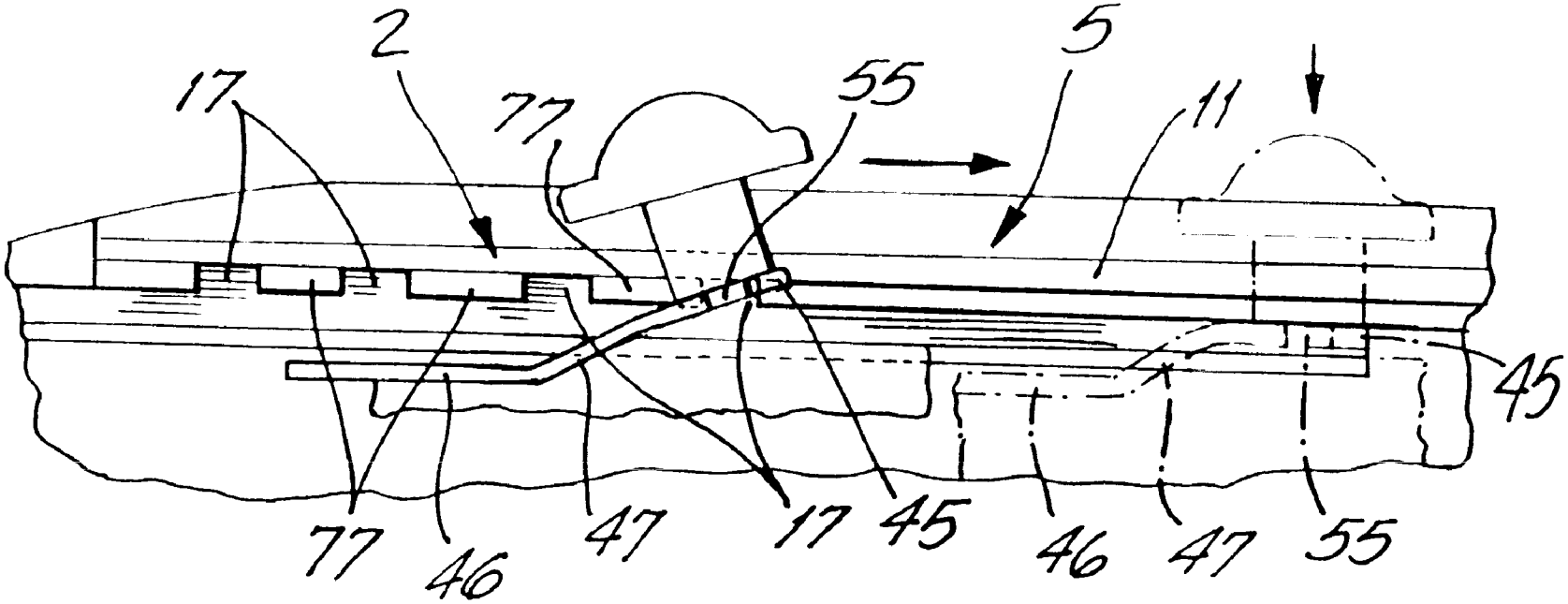
FIG. 17 is an enlarged schematic perspective view showing the position of some of the parts when the blade is to be moved to various positions.

The blade moving slide 50 with a blade B is adapted to slide in the slide slot 11-38 with the lock fingers 55 pointing away from each other and slidable in adjacent slide grooves 18-39 beneath ledges 14-12. As shown in FIG. 17, when push button 51 is depressed, the resilient strap 54 is depressed so that lock fingers 55 are moved beneath ledges 14-12 to permit the slide 50 to move back and forth with its lock fingers 55 sliding along the groove 18-39 beneath ledge 14-12 as well as beneath the lock notches 17-37. When the slide 50 reaches the desired position, the finger button 51 is released, the resilient strap 54 flexes up and the lock fingers 55 enter the lock notches 17-37 to hold the slide 50 in the desired position. When it is desired to again move the slide 50 and blade B forward or backward, the finger button 51 is depressed to move the lock fingers 55 out of the lock notches 17-37 and below lock notches 17-37 and ledges 14-12 and the slide 50 may the move back and forth as desired.

In order to pick up a new blade, the blade moving slide 50 is moved rearwardly toward the stack of blades. When the blade moving slide 50 is moved adjacent to the stack of stored blades B the support bar 57 of the slide 50 moves the pivoted blade leveling arm 21 out of the way to its folded position (FIG. 7) to free the stored blades B from any top pressure. In this position, the spring 42 in the cover 33 will move the blades B inwardly along the guide finger 36 toward magnets 15 so that the innermost blade B is moved off the end of the guide finger 36 and onto the pick-up finger 59 of the resilient blade carrier 58 (extending through lower opening 63 in support bar 57) which is inserted in the notch N to hold the blade B in place. When the blade moving slide 50 is moved forward, the pickup finger 59 will move the blade B forward to a position adjacent magnet 16, which assists in keeping the blade steady. The support bar 57 of slide 50 releases the blade leveling arm 21 which returns to its normal extended position by means of spring 22. The blade B is held steady by magnet 15 and by the pickup finger 59 is positioned in one of the notches N. In this position the blade moving slide 50 can be moved to the forward end of the casing 14 in order to expose the blade B. After use, the blade can be retracted back into the casing 14 by moving the blade moving slide 50 back.

In order to lock the blade B in a particular position (either with the blade exposed or with the blade retracted) the blade moving slide 50 is moved to the desired position by depressing finger button 51 which depresses the resilient strap 54 to move the lock fingers 55 out of the lock notches 17-37 and below lock notches 17-37 and ledges 14-12 so that the blade moving slide 50 is free to move back and forth. When the desired position is reached, the finger button 51 is released so that resilient strap 54 snaps up and with it lock fingers 55 which move into lock notches 17-37 in the side walls 6-29 to lock the blade B in position. When it is desired to again move the blade to a different position, the finger button 51 is again pushed down moving the lock fingers 55 out of the lock notches 17-37 and freeing the slide 50 to move back and forth in the slide groove 18-39 beneath ledges 14-12 and lock notches 17-37.

To remove a blade B from the casing, a spring pressed blade ejection button 41 is mounted at the forward end of the second casing half 3 and biased outwardly by spring 44. The ejection button 41 is at the same level as the upper blade release finger 60 extending from the resilient blade carrier 58. When it is desired to remove a blade B. the blade B is placed in its most forward position so that is protrudes from the mouth 10-30. At this point the inner edge 75 of the ejection button 41 is at the same level with the upper blade release finger 60 in the blade carrier 58. When the ejection button 41 is pressed inwardly against the bias of spring 44, its inner end 75 strikes the release finger 60 and moves it inwardly. This flexes the resilient blade carrier 58 inwardly to move the pick up button 59 inwardly and out of the upper notch N in the blade B. The flexing is facilitated by pin 65 located in slot 66. This releases the blade B and the blade B can then be removed manually from the mouth 10-30.

It will thus be seen that the present invention provides an improved utility knife in which the blades can be easily placed in an extended or retracted position, in which blades can be easily removed and replaced automatically, in which the blade can be easily locked in an extended or retracted position and which is simple to use and inexpensive to manufacture.

As many varied modifications of the subject matter of this invention will become apparent to those skilled in art from the detailed description given herein above, it will be understood that the present invention is limited only as provided in the claims appended hereto.

The embodiments of the invention in which an exclusive property or privilege is claimed are defined as follows:

1. A utility knife comprising a casing, said casing having lock means, blade moving means slidably mounted within said casing, said blade moving means having blade holding means adapted to receive a blade, said blade moving means comprising resilient means having lock mechanism extending therefrom, said lock mechanism adapted to cooperate with said lock means in said casing to hold the blade moving means in a predetermined position within the casing, said resilient means comprises a resilient strap, said resilient strap includes a rear upper step and a lower step spaced from said rear upper step, said steps being on different planes, said lock mechanism comprises lock teeth extending from said rear upper step, said upper step is connected to an upstanding finger button.

2. A utility knife as set forth in claim 1, wherein a platform depends from said lower step and said platform has a support bar extending there below, and said blade holding means is mounted on said support bar.

3. A utility as set forth in claim 2, wherein said blade holding means is resilient.

4. A utility knife as set forth in claim 3, wherein said blade holding means has a bending holding finger which extends through an opening in the support bar.

5. A utility knife as set forth in claim 4, wherein said resilient blade holding means has a release finger which extends through and opening in the support bar.

6. A utility knife as set forth in claim 5, wherein said casing has a slide slot and through which the body of the finger button extends.

7. A utility knife as set forth in claim 6, wherein said lock means comprises lock notches, teeth formed in each side of the casing to form lock tooth notches and wherein said lock teeth are adapted to enter into said lock notches.

8. A utility knife as set forth in claim 7, wherein said resilient strap permits the rear upper step to be depressed so that the lock teeth are moved out of the lock notches to a position beneath the lock notches to permit the lock teeth to slide relative to the lock notches.

9. A utility knife as set forth in claim 8, wherein a ledge is provided at the same level and coextensive with said lock notches to form a groove therebeneath to permit the lock teeth to slide beneath the groove.

* * * * *